US007486265B2

(12) United States Patent
Hosaka et al.

(10) Patent No.: US 7,486,265 B2
(45) Date of Patent: Feb. 3, 2009

(54) ELECTRO-OPTICAL DEVICE, METHOD OF DRIVING ELECTRO-OPTICAL DEVICE, AND ELECTRONIC APPARATUS

(75) Inventors: Hiroyuki Hosaka, Matsumoto (JP); Hidehito Iisaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 615 days.

(21) Appl. No.: 11/260,247

(22) Filed: Oct. 28, 2005

(65) Prior Publication Data

US 2006/0125942 A1 Jun. 15, 2006

(30) Foreign Application Priority Data

Nov. 10, 2004 (JP) ..... 2004-326274
Aug. 25, 2005 (JP) ..... 2005-244735

(51) Int. Cl.
*G09G 3/36* (2006.01)

(52) U.S. Cl. ..... 345/88; 345/102

(58) Field of Classification Search ..... 345/76–104
See application file for complete search history.

(56) References Cited

U.S. PATENT DOCUMENTS 6,965,367 B2 * 11/2005 Tanaka et al. ..... 345/102
7,030,848 B2 * 4/2006 Sato et al. ..... 345/95
7,199,780 B2 * 4/2007 Sekine ..... 345/102
2004/0041760 A1 3/2004 Tsumura et al.
2005/0225545 A1 10/2005 Takatori et al.

FOREIGN PATENT DOCUMENTS

JP A-11-237606 8/1999
JP 2002-221702 8/2002
JP A-2003-280601 10/2003
JP A-2004-93717 3/2004

* cited by examiner

*Primary Examiner*—Jimmy H Nguyen
(74) *Attorney, Agent, or Firm*—Oliff & Berridge, PLC

(57) ABSTRACT

A method of driving an electro-optical device includes dividing a vertical scanning period into first and second sub-fields of individual colors; stopping irradiation of light in the first sub-field; almost simultaneously selecting one scanning line and one or more adjacent scanning lines in a predetermined order; supplying to pixels data signals designating a gray-scale level of the color corresponding to one field, as data signals corresponding to the pixels located at the one scanning line among the selected scanning lines during each selection of the scanning lines; in the second sub-field, controlling the light so as to irradiate light of a corresponding color; selecting scanning lines other than the one scanning line; and supplying to pixels data signals designating a gray-scale level of the color corresponding to the one field, as data signals corresponding to the pixels of the selected scanning line during each selection of the scanning lines.

5 Claims, 7 Drawing Sheets

ELECTRO-OPTICAL DEVICE, METHOD OF DRIVING ELECTRO-OPTICAL DEVICE, AND ELECTRONIC APPARATUS

This application claims the benefit of Japanese Patent Applications No. 2004-326274, filed Nov. 10, 2004 and No. 2005-244735, filed Aug. 25, 2005. The entire disclosure of the prior applications are hereby incorporated by reference herein in its entirety.

BACKGROUND

1. Technical Field

The present invention relates to an electro-optical device driven by a so-called field sequential method, to a method of driving the electro-optical device, and to an electronic apparatus.

2. Related Art

In general, as shown in FIG. 7, one vertical scanning period (one frame) for forming one color image is composed of three continuous fields for displaying images of three primary colors including red (R), green (G), and blue (B) by a field sequential method. Further, each field has a scanning period to sequentially select pixel rows and a retrace period after the corresponding scanning period. Furthermore, for a scanning period of an R field, each of pixel rows is sequentially selected so as to write image data of an R component in each pixel, and red light is emitted in a subsequent retrace period. Further, for a scanning period of a G field, each of the pixel rows is sequentially selected so as to write image data of a G component in each pixel, and green light is emitted for a subsequent retrace period. Furthermore, for a scanning period of a B field, each of the pixel rows is sequentially selected so as to write image data of a B component in each pixel, and blue light is emitted for a subsequent retrace period. Thereby, images of primary colors of R, G, and B are sequentially displayed, which overlap each other to be displayed as a full color image. In such a field sequential method, a color filter does not need to be provided in a display element, so that bright display can be performed and each display element does not need to be separated into three segments of RGB, thereby facilitating implementation of high definition.

However, in the field sequential method, a light-emitting time or a luminance of light needs to increase in order to perform brighter display. In order to increase the light-emitting time, the retrace period can be increased. However, when the retrace period increases, a frame period increases (that is, a frame frequency decreases), so that display flicking starts to be visible. Alternatively, when the luminance of the light increases, a light source having high performance is required, which causes cost and consumed power to increase.

Accordingly, there has been suggested a technique of segmenting areas for a plurality of pixel rows and providing a light source for each segmented area and carrying out sequential light irradiation from a segmented area where image data writing has been already completed (for example, see JP-A-2002-221702 (FIG. 2)).

However, according to the above-mentioned technology, since the light source is provided for each segmented area, when a luminance difference between the light sources is generated, a boundary between the segmented areas becomes visible and the light source must be separately controlled for each segmented area. As a result, the control becomes complicated.

SUMMARY

An advantage of some aspects of the invention is that it provides an electro-optical device capable of achieving bright display and facilitating control of a light-source, a method of driving the same, and an electronic apparatus.

According to an aspect of the invention, there is provided a method of driving an electro-optical device, the electro-optical device including a plurality of pixels arranged to correspond to intersections between a plurality of scanning lines and a plurality data lines, each pixel maintaining a data signal supplied to a corresponding data line when a corresponding scanning line is selected, and a light source irradiating light of at least three different colors onto the individual pixels. The method comprising: dividing a vertical scanning period into fields for the individual colors, and each field into a first sub-field and a second sub-field, during the first sub-field of one field corresponding to any one color, stopping the light source from irradiating light; selecting one scanning line and one or more scanning lines adjacent to the one scanning line at substantially the same time; supplying, through the data lines, data signals corresponding to the pixels located at the one scanning line to pixels corresponding to the plurality of selected scanning lines; during the second sub-field subsequent to the first sub-field, controlling the light source so as to irradiate light of a corresponding color; selecting a scanning line other than the one scanning line among the scanning lines selected in the first sub-field; and supplying, through the data lines, data signals corresponding to the pixels of the selected scanning line to pixels corresponding to the selected scanning line. According to this aspect, since the plurality of scanning lines are simultaneously selected in the first sub-field, writing is completed for a shorter time than a case of selecting one row. Even when one vertical scanning period is constant, a period of the second sub-field where light is irradiated can be ensured. Accordingly, bright display can be achieved, and writing in the second sub-field is carried out on the pixel row where writing is not done in the first sub-field, so that display irregularities are not visible.

Preferably, the method of driving an electro-optical device further includes: selecting one of the scanning lines of odd and even rows and the scanning line adjacent to the one at almost the same time in the predetermined order in the first sub-field; and selecting the other in the predetermined order in the second sub-field. Further, preferably, the method of driving an electro-optical device further includes: repeating the vertical scanning period of selecting the scanning lines of odd rows in the predetermined order in the first sub-field and selecting the scanning lines of even rows in the predetermined order in the second sub-field, and the vertical-scanning period of selecting the scanning lines of even-numbered rows in the predetermined order in the first sub-field and selecting the scanning lines of odd-numbered rows in the predetermined order in the second sub-field with a predetermined period.

In addition, the invention may be applied to not only the method of driving an electro-optical device but also the electro-optical device and an electronic apparatus.

BRIEF DESCRIPTION OF THE DRAWINGS

The invention will be described with reference to the accompanying drawings, wherein like numbers reference like elements, and wherein.

DESCRIPTION OF EXEMPLARY EMBODIMENTS

Figure 1:
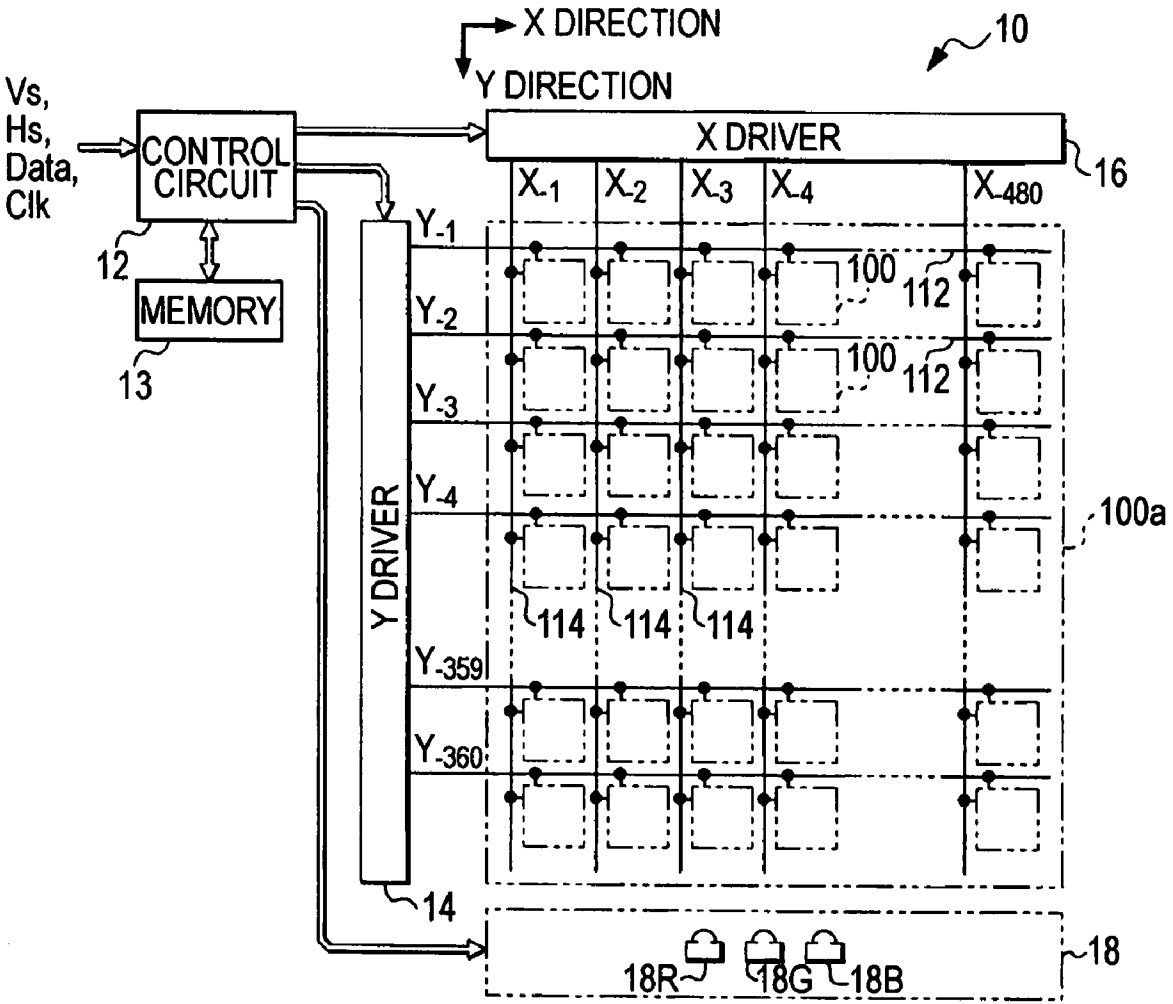
FIG. 1 is a block diagram illustrating a structure of an electro-optical device according to an embodiment of the invention.

Hereinafter, preferred embodiments of the invention will be described with reference to accompanying drawings. FIG. 1 is a block diagram illustrating a structure of an electro-optical device 10 according to the present embodiment.

As shown in FIG. 1, the electro-optical device 10 includes a control circuit 12, a memory 13, a Y driver 14, an X driver 16, a light source 18, 360 rows of scanning lines 112 extending in a horizontal direction (that is, X direction) and 480 columns of data lines 114 extending in a vertical direction (that is, Y direction). In addition, pixels 100 are arranged to correspond to intersections of the scanning lines 112 and the data lines 114. Accordingly, the pixels 100 are arranged in a matrix of 360 rows×480 columns in the present embodiment, so that a display region 100*a* is formed.

The display region 100*a* has an element substrate where pixel electrodes are formed and a transparent counter substrate having a common electrode, and the element substrate and the counter substrate are bonded to each other with a predetermined gap therebetween and liquid crystal is interposed between them.

The control circuit 12 controls the operation of each unit of the electro-optical device 10. Specifically, the control circuit 12 transmits display data Data supplied from a host device (not shown) in synchronization with a vertical scanning signal Vs, a horizontal scanning signal Hs and a dot clock signal Clk to the memory 13 so as to be stored therein, and reads the display data Data from the memory 13 in synchronization with the vertical scanning and the horizontal scanning of the display region 100*a* and supplies it to the X driver 16. In order to carry out the vertical scanning and the horizontal scanning, the control circuit 12 supplies necessary clock signals or the like to the Y driver 14 and the X driver 16.

In this case, the display data Data is data which designates the brightness of each pixel (gray-scale level) for each primary color of RGB. In the present embodiment, as will be described below, one vertical scanning period (one frame) is divided into continuous fields for each color of RGB, and each field is divided into first and second sub-fields, and vertical scanning of the display region 10*a* is performed in a different manner in the first and second sub-fields. For this reason, the control circuit 12 makes the display data Data supplied from the host device and corresponding to at least one frame stored in the memory 13, and reads display data of a corresponding color component in each sub-field to supply it to the X driver 16. In addition, the control circuit 12 controls turning on and off of the light source 18, which will be described in detail below.

The Y driver 14 (scanning line driving circuit) serves to supply a scanning signal to each of the scanning lines 112 of 360 rows, which will be described in detail below, and selects each scanning line 112 in a predetermined order according to the first and second sub-fields. In this case, scanning signals supplied to the scanning lines 112 of the first row to the 360-th row are denoted as $Y_{1}$, $Y_{2}$, $Y_{3}$, . . . , and $Y_{360}$ in FIG. 1.

The X driver 16 (data line driving circuit) converts the display data of pixels of one row located at each of the selected scanning lines 112 into data signals of a voltage suitable for driving the liquid crystal, and supplies them to the pixels 100 through the data lines 114. In this case, data signals supplied to the data lines 114 of the first column to the 480-th column are denoted as $X_{1}$, $X_{2}$, $X_{3}$, . . . , and $X_{480}$ in FIG. 1.

The light source 18 is a so-called backlight unit which includes a red LED 18R, a green LED 18G, and a blue LED 18B, and uniformly irradiates light of any one of red (R), green (G), and blue (B) onto the display region 100*a*. In this case, the control circuit 12 controls light emission of each of the LEDs provided in the light source 18.

Next, a structure of the pixel 100 will be described with reference to FIG. 2.

Figure 2:
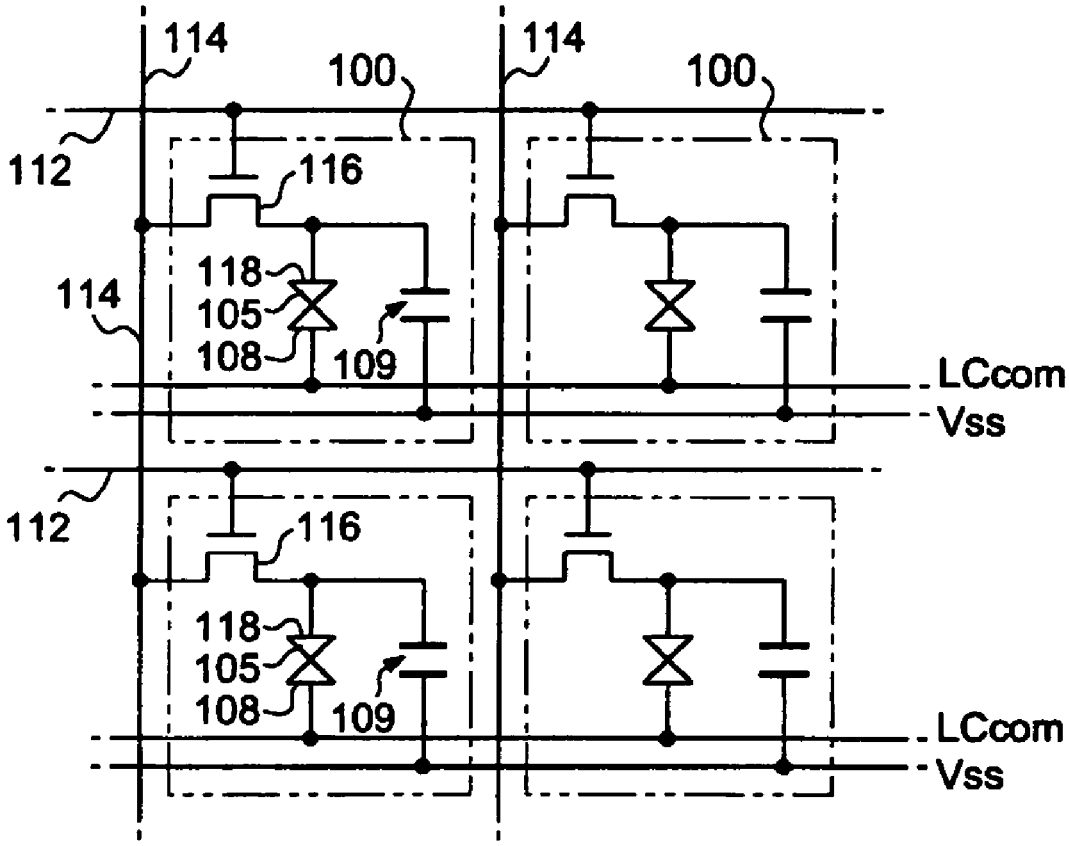
FIG. 2 is a circuit diagram illustrating a structure of a pixel in the electro-optical device.

As shown in FIG. 2, in the pixel 100, a source of a thin film transistor (TFT) of an N-channel type 116 is connected to the data line 114, a drain of the TFT is connected to the pixel electrode 118, and a gate of the TFT is connected to the scanning line 112.

In addition, the common electrode 108 opposite to the pixel electrodes 118 is commonly provided with respect to all the pixels, and a temporally constant voltage LCcom is applied thereto in the present embodiment. In addition, a liquid crystal layer 105 is interposed between the pixel electrode 118 and the common electrode 108. Accordingly, a liquid crystal capacitor composed of the pixel electrode 118, the common electrode 108, and the liquid crystal layer 105 is constructed for each pixel.

Although not shown, an alignment film, which is subjected to a rubbing process such that a long axis direction of the liquid crystal molecule is continuously twisted at about 90 degrees between both substrates, is provided on each facing surface of both substrates, and a polarizer whose transmission axis aligns with the alignment direction is provided on each rear surface of both substrates.

For this reason, since light passing between the pixel electrode 118 and the common electrode 108 optically rotates at about 90 degrees according to the twist of the liquid crystal molecule when an effective voltage value applied to the liquid crystal capacitor is zero, the transmittance of the light becomes maximized. In contrast, the liquid crystal molecule is inclined toward an electric field direction as the effective voltage value increases, so that the optical rotation is lost. As a result, an amount of transmitted light decreases, so that the transmittance becomes minimized (normally white mode).

Accordingly, light emitted from the light source 18 is visible to a user in a limited state according to the effective voltage value applied to the liquid crystal capacitor for each pixel, so that so-called gray-scale display can be achieved.

In addition, in order to reduce an effect of charge leakage from the liquid crystal capacitor through the TFT 116, a storage capacitor 109 is provided for each pixel. One end of the storage capacitor 109 is connected to the pixel electrode 118 (that is, the drain of the TFT 116) while the other end is commonly connected to a low electrical potential Vss of a power supply over all the pixels.

Figure 3:
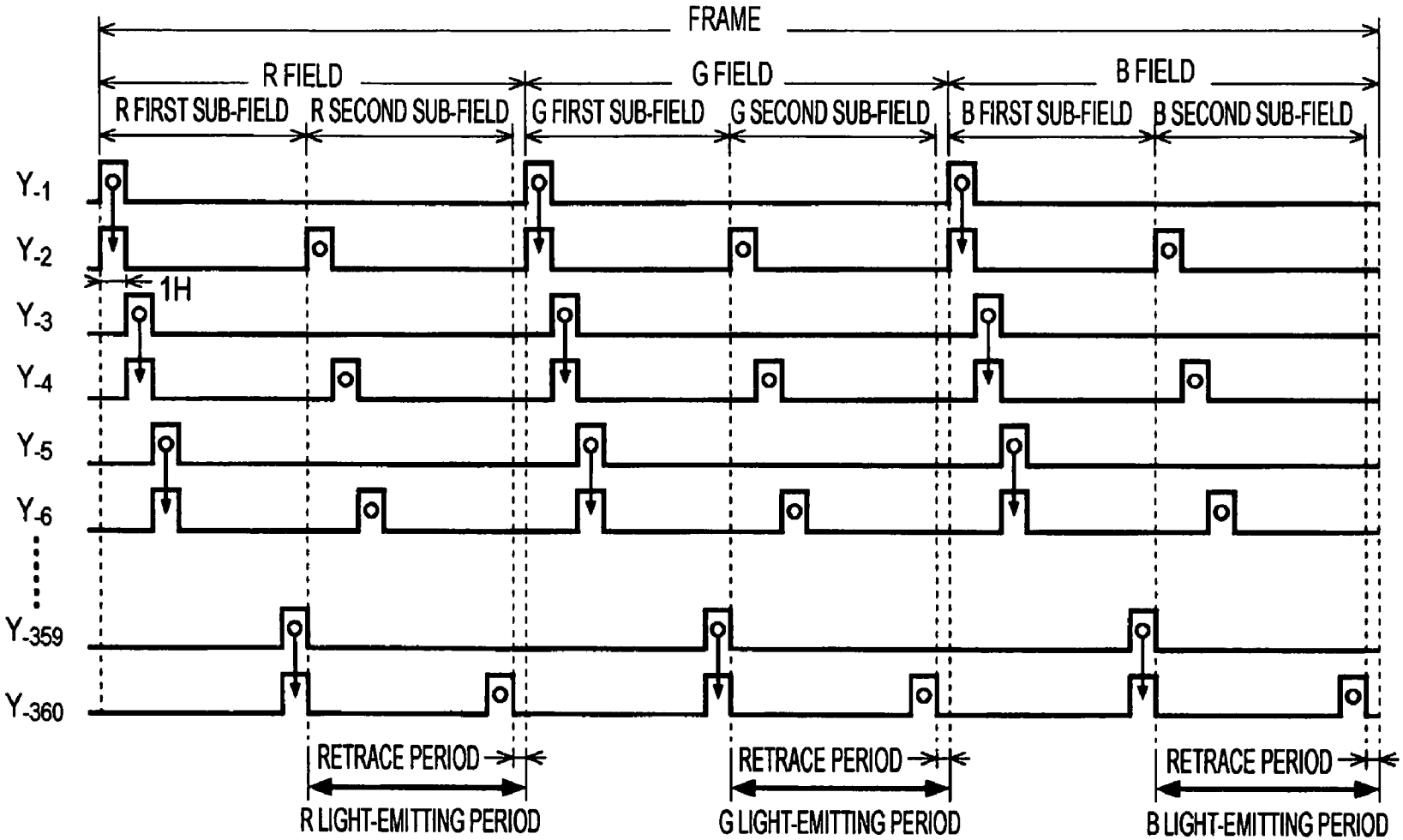
FIG. 3 is a timing chart illustrating the operation of the electro-optical device.

Next, the operation of the electro-optical device 10 according to the present embodiment will be described. FIG. 3 is a timing chart illustrating the vertical scanning operation of the electro-optical device 10.

As shown in FIG. 3, in the present embodiment, one vertical scanning period (that is, one frame) is divided into three fields corresponding to RGB fields, and each field is divided into first and second sub-fields.

In this case, for the first sub-field of an R field of one vertical scanning period, the control circuit 12 controls the light source 18 such that all LEDs are turned off, and controls the Y driver 14 such that a scanning line 112 of an odd-numbered row when counted from the top in FIG. 1 and a scanning line 112 of an even-numbered row adjacent to the corresponding odd-numbered row in a downward direction constitute a pair and a plurality of pairs of scanning lines are sequentially selected downward from the top for each one horizontal scanning period (1H).

Thereby, as shown in FIG. 3, during the first one horizontal scanning period 1H of the first sub-field of the R field, only the scanning signals $Y_{1}$ and $Y_{2}$ become H levels at the same time, only the scanning signals $Y_{3}$ *and* $Y_{4}$ then become H levels at the same time, only the scanning signals $Y_{5}$ and $Y_{6}$ then become H levels at the same time, the scanning signals of the odd-numbered rows and the even-numbered rows subsequent to the odd-numbered rows then become H levels sequentially at the same time in the same manner as the above-mentioned description, and the final scanning signals $Y_{359}$ and $Y_{360}$ become H levels at the same time.

The control circuit 12 controls the Y driver 14 such that the Y driver selects the scanning lines 112 of the odd-numbered row and the even-numbered row subsequent to the odd-numbered row at the same time, and controls the X driver 16 as follows. That is, the control circuit 12 controls the X driver 16 such that the X driver reads from the memory 13 the display data of an R component as display data Data corresponding to one row of pixels located at the scanning line 112 of the odd-numbered row to be selected and transmits it to the X driver 16 before the odd-numbered row and the even-numbered row are simultaneously selected, and converts the data signals of one row of pixels located at the scanning line 112 of the odd-numbered row from the display data Data of the R component and outputs them simultaneously, when the odd-numbered row and the even-numbered row are simultaneously selected.

Thereby, the X driver 16 outputs the data signals $X_{1}$, $X_{2}$, $X_{3}$, . . . , and $X_{480}$ of pixels located in the odd-numbered row between the two selected rows, that is, data signals of a voltage according to a gray-scale level of the R component, to the corresponding data lines 114.

In this case, when the scanning line 112 of any odd-numbered row is selected and its scanning signal becomes a H level, the TFTs 116 of the pixels 100 located at the scanning line 112 of the selected odd-numbered row are turned on. Therefore, when considering the data line 114 of any one column, a voltage of the data signal of the corresponding column is written in the pixel electrode 118 of the pixel corresponding to an intersection between the selected scanning line 112 and the data line 114 of the corresponding column. However, when the odd-numbered row is selected in the present embodiment, the scanning line 112 of even-numbered row adjacent to the selected odd-numbered row in a downward direction is also selected at the same time, so that a voltage of the data signal of the corresponding column is also written in the pixel electrode 118 of the pixel corresponding to an intersection between the scanning line 112 of the selected even-numbered row and the data line 114 of the corresponding column.

Figure 5A:
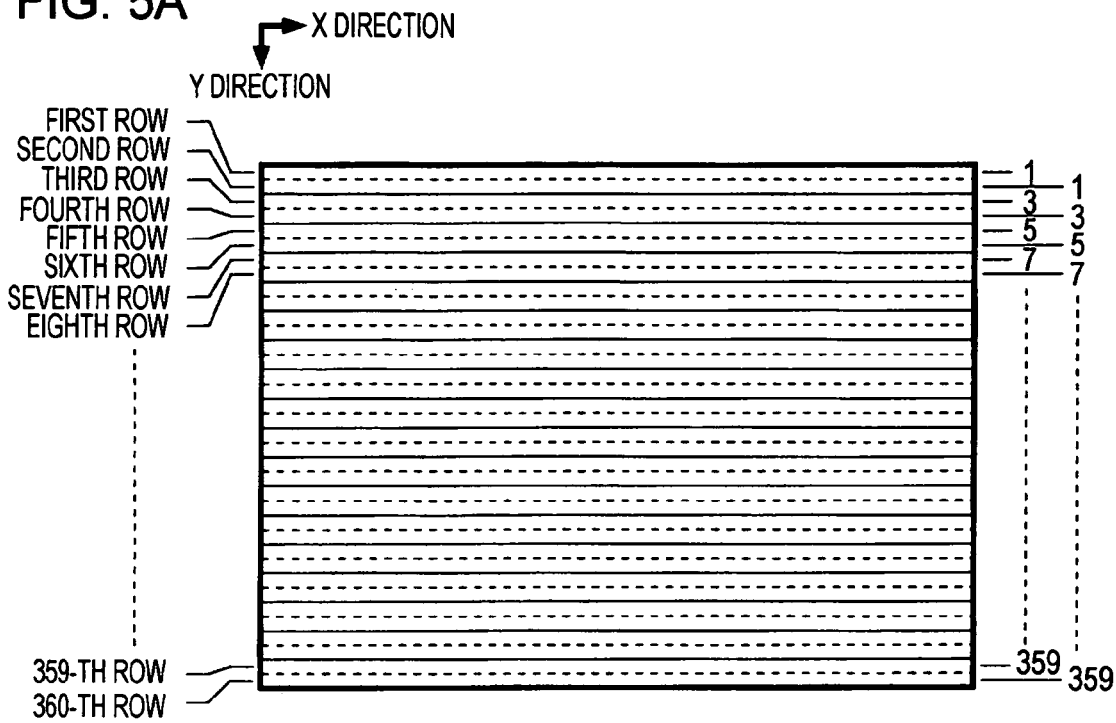
FIG. 5 is a diagram illustrating a display state in the electro-optical device.

Accordingly, if the scanning line 112 of the odd-numbered row and the scanning line 112 of the even-numbered row adjacent to the odd-numbered row in a downward direction are selected at the same time, since the same data signal is written in two pixels 100 corresponding to the two rows, the two pixels have the same amount of transmitted light according to a voltage of the corresponding data signal. Accordingly, the same gray-scale display is performed for each column in the odd-numbered row and the even-numbered row adjacent to the odd-numbered row in a downward direction at the time of ending the first sub-field of the R field, as shown in FIG. 5. However, all LEDs of the light source 18 are turned off until the end of the first sub-field of the R field, so that a display aspect through the writing in only the first sub-field is not visible to an observer.

Subsequently, for the second sub-field of the R field, the control circuit 12 controls the light source 18 such that only the red LED 18R emits light, and also controls the Y driver 14 such that only scanning lines 112 of even-numbered rows are sequentially selected downward from the top for each one horizontal scanning period (1H).

Thereby, as shown in FIG. 3, only the scanning signal $Y_{2}$ becomes an H level for the first one horizontal scanning period (1H) of the second sub-field of the R field, and only the scanning signal $Y_{4}$ becomes an H level for a next one horizontal scanning period, and the scanning signal $Y_{360}$ becomes a H level in the same manner.

The control circuit 12 controls the Y driver 14 such that only scanning lines 112 of even-numbered rows are selected, and controls the X driver 16 as follows. That is, the control circuit 12 controls the X driver 16 at the time of selecting each scanning line such that data signals of pixels located at the scanning line 112 of the selected even-numbered row are output simultaneously.

Thereby, the X driver outputs the data signals $X_{1}$, $X_{2}$, $X_{3}$, . . . , and $X_{480}$ of the pixels located in the selected even-numbered row to the corresponding data lines 114.

In this case, in a case in which the scanning line 112 of any even-numbered row is selected and its scanning signal becomes an H level, if considering the data line 114 of any one column, a voltage of the data signal of the corresponding column is written in the pixel electrode 118 of a pixel corresponding to an intersection between the selected scanning line 112 and the data line 114 of the corresponding column.

In addition, writing is not carried out in the second field in the pixel of the odd-numbered row, so that the pixel holds the writing voltage of the first sub-field.

Figure 5B:
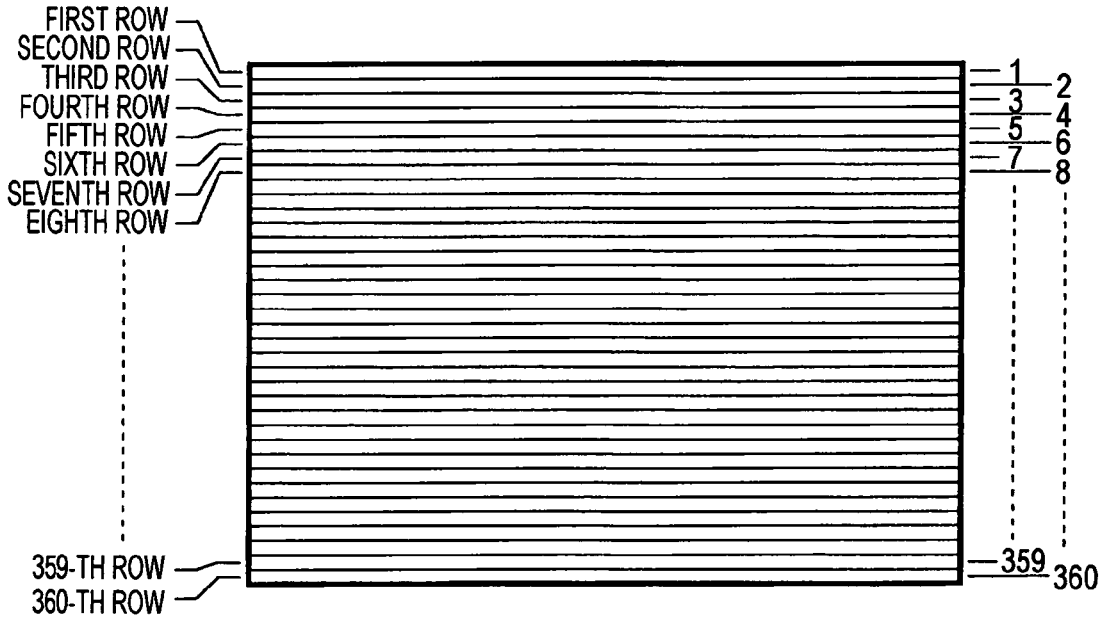

Accordingly, at the time of ending the second sub-field of the R field, a gray-scale level through the writing in the first sub-field is held in the odd-numbered row while a gray-scale level through the second writing in the second sub-field is held in the even-numbered row, as shown in FIG. 5B.

In this case, the red LED 18R emits light in the second sub-field, so that the even-numbered row holds a gray-scale level through the writing in the first sub-field until the writing is carried out and has an original gray-scale level through the writing in the second sub-field. Accordingly, a visibility ratio between the current gray-scale level and the original gray-scale level increases toward the upper row and decreases toward the lower row. However, a visibility ratio between the current gray-scale level and the original gray-scale level in the even-numbered row becomes about half on average, and writing in the first sub-field has already been performed in the original odd-numbered row to be visible with its original gray-scale level, so that degradation of the resolution is not problematic.

In the present embodiment, the control circuit 12 controls the red LED 18R so as to continuously emit light even in a retrace period until a next G field starts after selection of the even-numbered row is completed in the second sub-field of the R field.

As such, in the second sub-field of the R field and a retrace period right after the second sub-field, an image of an R component among full color images is visible to an observer.

Next, a G field will be described. The data signals on the basis of the display data Data of the R component are written in the R field while data signals on the basis of the display data Data of a G component are written in the G field. The same operation as the R field is carried out in the G field.

Accordingly, in the first sub-field of the G field, all LEDs are turned off, and scanning lines 112 of even and odd-numbered rows are selected two by two in order from the top to the bottom, and data signals of a voltage according to the gray-scale level of a G component are written on the basis of display data of pixels located at the selected odd-numbered row, and in the second sub-field, only the green LED 18G emits light, and only scanning lines 112 of even-numbered rows are sequentially selected in order from the top to the bottom. As a result, data signals of a voltage according to the gray-scale level of the G component are written in the pixels of each of the selected even-numbered rows. For this reason, in the second sub-field of the G field and a retrace period right after the second sub-field, an image of the G component among full color images is visible to an observer.

In the same manner, the operation of writing data signals based on the display data Data of a B component is carried out during the B field. That is, during the first sub-field of the B field, all LEDs are turned off, scanning lines 112 of even and odd-numbered rows are sequentially selected two by two in order from the top to the bottom, and data signals of a voltage according to the gray scale of a B component are written on the basis of display data of pixels located at the selected odd-numbered row. During the second sub-field, only the blue LED 18B is turned on, and only scanning lines 112 of even-numbered rows are sequentially selected in order from the top to the bottom, so that data signals of a voltage according to the gray-scale level of the B component are written in pixels of each of the selected even-numbered rows. Accordingly, in the second sub-field of the B field and a retrace period right after the second sub-field, an image of the B component among full color images is visible to an observer.

Accordingly, original color images of R, G, and B components are formed in the R, G, and B sub-fields, respectively, so that a composite full color image becomes visible to an observer when seeing them in one frame.

Figure 7:
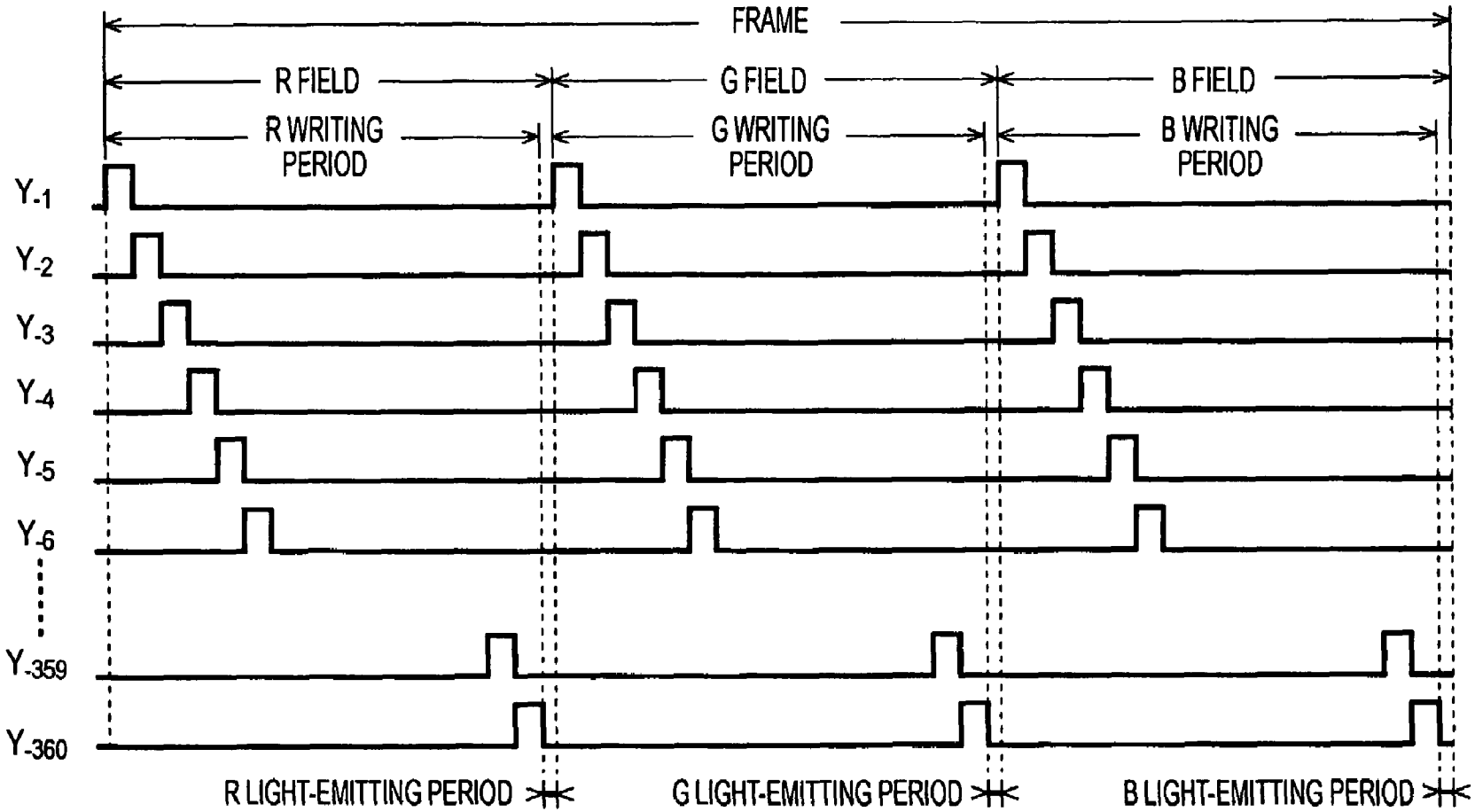
FIG. 7 is a timing chart illustrating the operation of an electro-optical device according to the related art.

According to the present embodiment as described above, a writing period, which is required for writing data signals of a voltage according to a gray-scale level of each color component of RGB by simultaneously selecting the scanning lines 112 two by two in the first sub-field, can decrease to about a half as compared with the related art selecting the scanning line one by one (see FIG. 7). Accordingly, even when the period of the R field is constant in the present embodiment, the long period of the second sub-field can be guaranteed. Further, according to the present embodiment, the LED of any one color emits light during the second sub-field and its retrace period, so that the light-emitting period can increase as compared with the related art, which allows brighter display to be performed.

In this case, since only one LED for each color may be turned on in the light source 18, a brightness difference between segmented areas does not occur, and complicated control of the light source per segmented area is not required. Further, a structure of an illumination device is not complicated.

However, in the above-mentioned embodiment, the data signals written to two rows in the first sub-field belong to the odd-numbered row. In the second sub-field, LEDs of the written color emit light, and data signals of the same color component are written to pixels of the even-numbered rows which are sequentially selected. When this relationship is fixed, the pixels of even-numbered rows always have a quality inferior to the pixels of odd-numbered rows.

Figure 4:
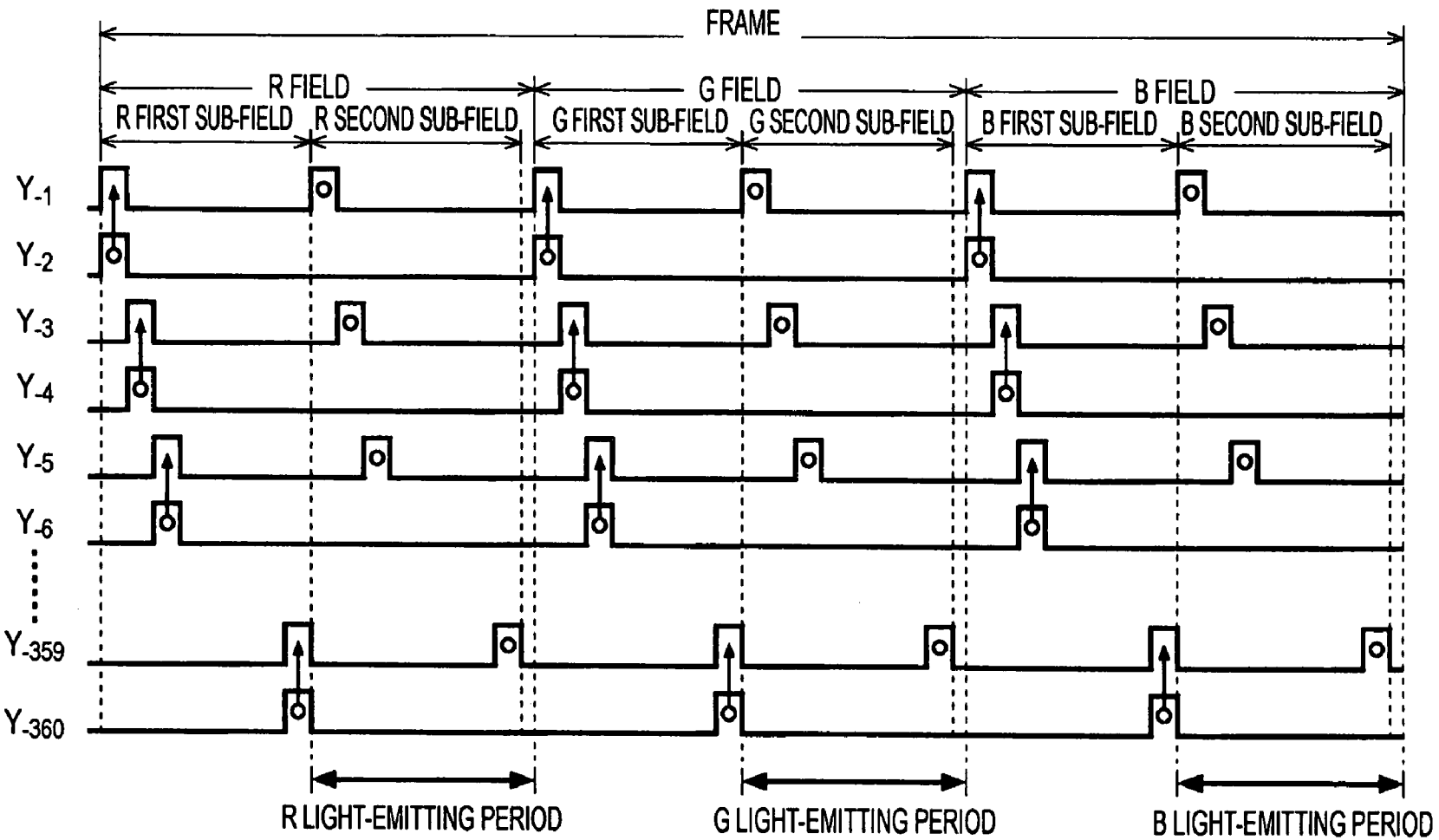
FIG. 4 is a timing chart illustrating the operation of the electro-optical device.

Accordingly, as shown in FIG. 4, it is also possible to prepare a frame that data signals written to two rows in the first sub-field belong to the even-numbered row, and only the odd-numbered rows are sequentially selected and the data signals of the selected odd-numbered rows are written in the second sub-field, and the frame shown in FIG. 3 and the frame shown in FIG. 4 may be alternately repeated with a predetermined period.

In this case, in order to prevent deterioration of the liquid crystal, the data signals of a low voltage and a high voltage are alternately inverted on the basis of the voltage LCcom applied to the common electrode 108 (that is, alternative current driving). However, if a period of the alternative current driving matches a period of alternately repeating the frame shown in FIG. 3 and the frame shown in FIG. 4, a writing polarity of the scanning row written in the second sub-field, that is, a writing polarity visible to an observer becomes fixed to the even-numbered row and the odd-numbered row, which causes flickering. Accordingly, it may be preferable to have a configuration that the period of the alternative current driving does not match the period of alternately repeating the frame shown in FIG. 3 and the frame shown in FIG. 4.

In addition, in the above-mentioned embodiment, scanning lines 112 corresponding to two rows are simultaneously selected from the top in the first sub-field. However, at least three scanning lines may be selected at the same time, and data signals of any one row of the selected rows may be supplied and the pixel rows to which the data signals are not supplied in the first sub-field may be sequentially selected in the second sub-field to newly supply the data signals to the selected scanning lines.

As described above, when the scanning lines are sequentially selected in order from the top to the bottom in the second sub-field, a visibility ratio between the current gray-scale level and the original gray-scale level increases toward the upper row and decreases toward the lower row.

Accordingly, the pixel rows to which data signals are not supplied in the first sub-field may be sequentially selected in order from the top to the bottom in the second sub-field of any one frame, and may be sequentially selected in order from the bottom to the top in the second sub-field of another frame.

In addition, a plurality of selection orders are prepared in advance, and pixel rows to which data signals are not supplied in the first sub-field are sequentially selected in any one of the orders, so that it is possible to resolve a depending state in which the visibility ratio between the current gray-scale level and the original gray-scale level according to the position of the pixel row is reduced.

Further, according to the above-described embodiment, the LED of any one color emits light even in the retrace period after the second sub-field, however, the LED may be turned off in the entire retrace period or a partial period thereof when it is possible to obtain the sufficient brightness only with the light emission during the second sub-field.

Furthermore, according to the above-described embodiment, a normally white mode has been described which performs the white display when the effective voltage value between the common electrode 108 and the pixel electrode

118 is small, however, a normally black mode performing black display may be employed.

In addition, according to the above-described embodiment, a twisted nematic (TN) type is used as the liquid crystal, however, a bi-stable type having a memory property such as a bi-stable twisted nematic (BTN type) and a ferroelectric type, a high molecular dispersion type, or a guest-host (GH) type in which a dye (guest) having anisotropy with respect to absorption of visible rays in the long axis direction and the short axis direction of molecule is dissolved in liquid crystal (host) having constant molecular arrangement and the dye molecule is arranged in parallel to the liquid crystal molecule may be employed.

In addition, a vertical (that is, homeotropic) alignment type may be employed in which the liquid crystal molecule is arranged in a vertical direction to both substrates at the time of applying no voltage while it is arranged in a horizontal direction to both the substrates at the time of applying voltage, or a horizontal (that is, homogeneous) alignment type may be employed in which the liquid crystal molecule is arranged in a horizontal direction to both the substrates at the time of applying no voltage while it is arranged in a vertical direction to both the substrates at the time of applying voltage. As such, in the invention, various liquid crystal types and alignment types can be employed.

Figure 6:
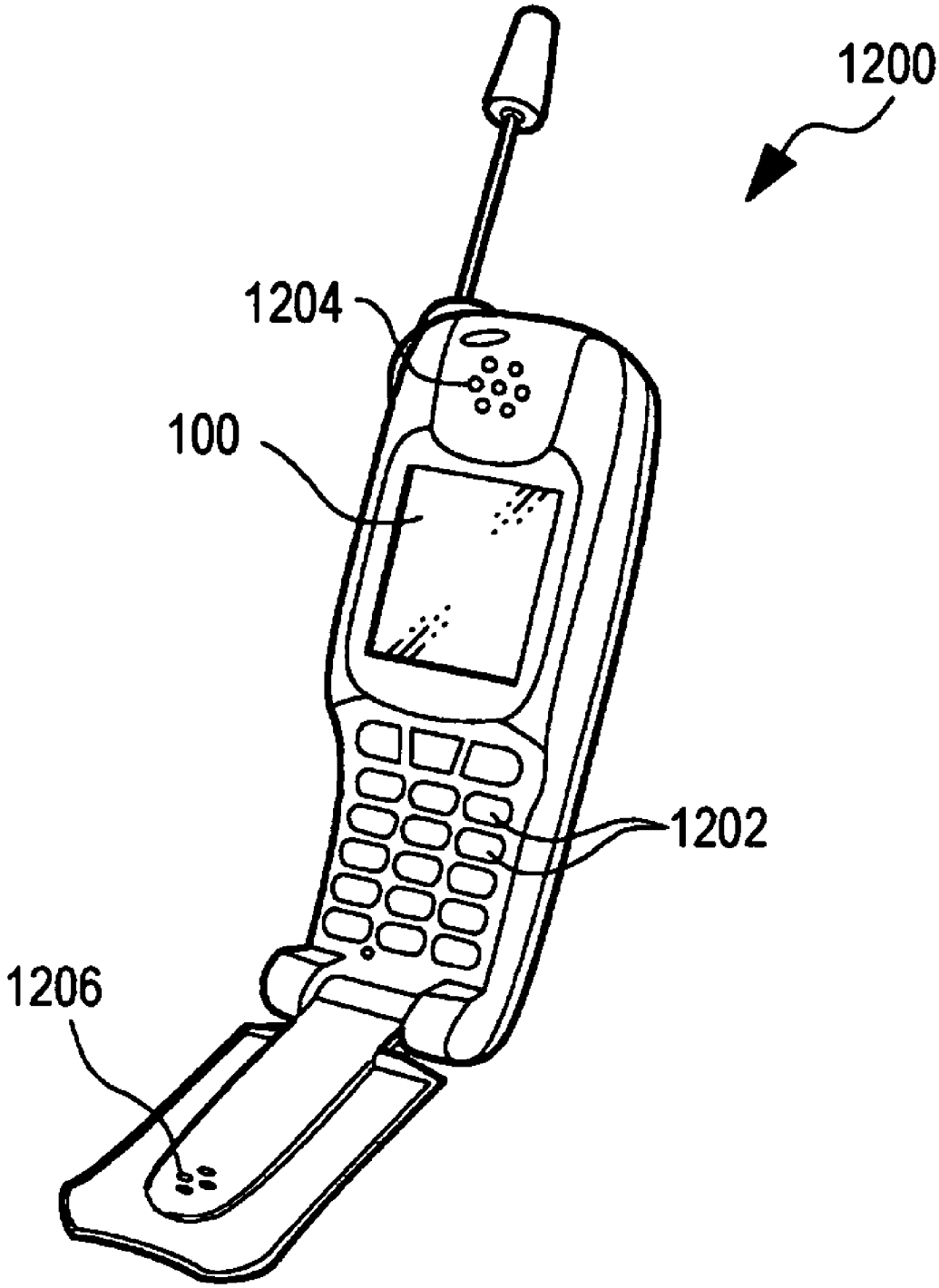
FIG. 6 is a perspective view illustrating a structure of a cellular phone to which the electro-optical device is applied.

Next, an example that the electro-optical device 10 tested as described above is applied to a specific electronic apparatus will be described. FIG. 6 is a perspective view illustrating a structure of a cellular phone in which the electro-optical device 10 is applied to a display unit.

Referring to FIG. 6, a cellular phone 1200 includes a plurality of operation buttons 1202, an earpiece 1204, a mouthpiece 1206, and the electro-optical device 10. In addition, besides the cellular phone described with reference to FIG. 6, examples of the electronic apparatus include a liquid crystal television, a view-finder-type or a monitor-direct-view-type vide tape recorder, a car navigation device, a pager, an electronic note, an electronic calculator, a word process, a work station, a video phone, a POS terminal, a direct-view-type device such as a touch panel, a projection device such as a projector forming a reduced-image and projecting the enlarged image, and so forth.

What is claimed is:

1. A method of driving an electro-optical device, the electro-optical device including a plurality of pixels arranged to correspond to intersections between a plurality of scanning lines and a plurality data lines, each pixel maintaining a data signal supplied to a corresponding data line when a corresponding scanning line is selected, and a light source irradiating light of at least three different colors onto the individual pixels, the method comprising:

dividing a vertical scanning period into fields for the individual colors, and each field into a first sub-field and a second sub-field, during the first sub-field of one field corresponding to any one color, stopping the light source from irradiating light;

selecting one scanning line and one or more scanning lines adjacent to the one scanning line at substantially the same time;

supplying, through the data lines, data signals corresponding to the pixels located at the one scanning line to pixels corresponding to the plurality of selected scanning lines;

during the second sub-field subsequent to the first sub-field, controlling the light source so as to irradiate light of a corresponding color;

selecting a scanning line other than the one scanning line among the scanning lines selected during the first sub-field; and supplying, through the data lines, data signals corresponding to the pixels of the selected scanning line to pixels corresponding to the selected scanning line.

2. The method of driving an electro-optical device according to claim 1, further comprising:

selecting one scanning line of scanning lines of odd and even rows and a scanning line adjacent to the one scanning line at almost the same time in the predetermined order in the first sub-field; and selecting the other scanning line of the scanning lines of odd and even rows in the predetermined order in the second sub-field.

3. The method of driving an electro-optical device according to claim 2, further comprising:

repeating with a predetermined period a vertical scanning period of selecting the scanning lines of odd rows in the predetermined order in the first sub-field and selecting the scanning lines of even rows in the predetermined order in the second sub-field, and a vertical scanning period of selecting the scanning lines of even rows in the predetermined order in the first sub-field and selecting the scanning lines of odd rows in the predetermined order in the second sub-field.

4. An electro-optical device comprising:

a plurality of pixels that are arranged to correspond to intersections between a plurality of scanning lines and a plurality data lines, each pixel maintaining a data signal supplied to a corresponding data line when a corresponding scanning line is selected, a vertical scanning period being divided into fields for the individual colors, and each field being divided into a first sub-field and a second sub-field;

a light source that irradiates light of at least three different colors onto the individual pixels;

a control circuit that controls the light source such that irradiation of light from the light source is stopped during a first sub-field of a field corresponding to any one color and light of the corresponding color is irradiated during a second sub-field subsequent to the first sub-field;

a scanning line driving circuit that selects one scanning line and one or more scanning lines adjacent to the one scanning line at substantially the same time during the first sub-field of the field corresponding to any one color, and selects scanning a line other than the one scanning line during the second sub-field subsequent to the first sub-field; and a data line driving circuit which supplies through the data lines data signals corresponding to the pixels located at the one scanning line to pixels corresponding to the plurality of selected scanning lines, when the one scanning line and one or more scanning lines adjacent to the one scanning line are selected during the first sub-field, and supplies through the data lines data signals corresponding to the pixels located at the selected scanning line to pixels corresponding to the selected scanning line, when the scanning line other than the one scanning line is selected during the second sub-field subsequent to the first sub-field.

5. An electronic apparatus comprising the electro-optical device according to claim 4.

* * * * *